United States Patent [19]

Yamamoto et al.

[11] Patent Number: 4,774,870

[45] Date of Patent: Oct. 4, 1988

[54] KNOTTING METHOD FOR A NETTING

[75] Inventors: Yoshiji Yamamoto; Kaname Yamamoto, both of Toyohashi, Japan

[73] Assignee: Amita Iron Works Inc., Toyohashi, Japan

[21] Appl. No.: 139,084

[22] Filed: Dec. 23, 1987

Related U.S. Application Data

[63] Continuation of Ser. No. 5,695, Jan. 21, 1987, abandoned.

[30] Foreign Application Priority Data

Feb. 27, 1986 [JP] Japan ..... 61-42197

[51] Int. Cl.[4] ..... D04G 1/02; D04G 1/08

[52] U.S. Cl. ..... 87/12; 87/53; 289/1.5; 289/2

[58] Field of Search ..... 87/12, 53; 289/5–9, 289/1.2, 1.5, 2

[56] References Cited

U.S. PATENT DOCUMENTS

| | | | |
|---|---|---|---|
| 3,995,898 | 12/1976 | Momoi | 289/1.5 |
| 4,047,316 | 9/1977 | Maruyama | 87/12 X |
| 4,226,165 | 10/1980 | Maruyama et al. | 87/12 |
| 4,445,416 | 5/1984 | Iijima et al. | 87/12 |

*Primary Examiner*—John Petrakes

*Attorney, Agent, or Firm*—Lahive & Cockfield

[57] ABSTRACT

A knotting method for a netting is disclosed which comprises the steps of seizing together a warp yarn which is paid out from a creel stand and a weft yarn which is paid out from a shuttle to form substantially concentric loops which are opposite in yarn feed direction to each other, pulling out the warp yarn upstream of the loop with respect to a feed direction of the warp yarn through the concentric loops to the opposite side, causing a weft supply side where the weft yarn is paid out to pass through a loop which is formed by the warp yarn as pulled out through the concentric loops, and tightening the warp and weft yarns which are intertwined. The resultant knot is firm and very small.

17 Claims, 6 Drawing Sheets

KNOTTING METHOD FOR A NETTING

This application is a continuation of application Ser. No. 5,695, filed Jan. 21, 1987, now abandoned.

BACKGROUND OF THE INVENTION

1. Field of the Invention

The present invention relates to a knotting method which is applicable to a netting production line, particularly a fishing net production line.

2. Description of Prior Art

Fishing nets are generally classified in terms of structure mainly into three types, i.e., a knotted net, a knotless net and a twisted net, and a predominant one of the three different types of nets is the knotted net. Further, knots of knotted nets are divided broadly into an English knot, a double English knot, and a reef knot or flat knot. Among the three kinds of knots, the English knot is superior to the others with respect to production efficiency and costs. The double English knot is an improved version of the English knot in terms of firmness of knot and allows a minimum of change in the mesh configuration to occur in a product. Traditionally, the double English knot has been believed to be the supreme knot configuration for a gill net which is made of nylon.

Meanwhile, since it has been reported that a gill net constituted by nylon monofilaments increases the haul, nylon monofilaments are increasingly used as a material of gill nets. However, because a nylon monofilament is highly stiff and slippery, the traditional knotting means as described above render a gill net which is constituted by intertwined nylon monofilaments liable to deformation of its meshes. To achieve firmer knots, various knotting methods have heretofore been developed which intertwine a warp yarn and a weft yarn in a complicated configuration to avoid deformation, or shifts, of the meshes. A problem with a gill net having such firm knots is that the productivity is limited because knotting relies on complicated intertwining of a warp yarn and a weft yarn as stated. Another problem is that, because only rigidity of knots is pursued, the knotted portions are conspicuously large and therefore, obstructive to the enhancement of haul.

SUMMARY OF THE INVENTION

It is therefore an object of the present invention to provide a knotting method for a netting which, where the netting is constituted by nylon monofilaments, allows knots of the netting to have firmness great enough to avoid shifts of meshes despite the slippery nature of nylon monofilaments.

It is another object of the present invention to provide a knotting method for a netting which, where the netting is constituted by nylon monofilaments (or any other synthetic fiber raw material), makes knots of the netting inconspicuously small so as not to affect a haul.

It is another object of the present invention to provide a generally improved knotting method for a netting.

A knotting method for a netting of the present invention comprising the steps of twisting 180 degrees a warp yarn and a weft yarn which are hooked alongside of each other with feed directions thereof opposing each other, thereby forming a loop, pulling through the loop portion of the warp yarn on a warp feed side where the warp yarn is fed to a weft feed side where the weft yarn is fed and opposite to the warp feed side and forming another loop by that portion of the weft yarn, causing the weft feed side to go through the other loop, and applying tension to the warp and weft yarns to tighten the yarns together.

In accordance with the present invention, a warp yarn which is paid out from a creel stand and a weft yarn which is paid out from a shuttle are seized together to form substantially concentric loops which are opposite in yarn feed direction to each other. Then, the warp yarn upstream of the loop with respect to the feed direction of the warp yarn is pulled out through the concentric loops to the opposite side. This is followed by causing a weft supply side where the weft yarn is paid out to pass through a loop which is formed by the warp yarn as pulled out through the concentric loops. Finally, the warp and weft yarns are intertwined tightly by application of a tension.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
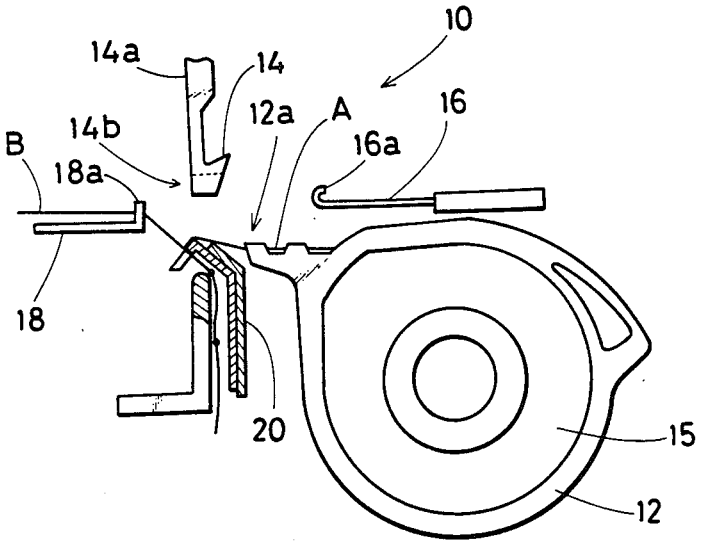
FIG. 1 is a fragmentary perspective view of a knotting section which is included in a net producing machine for practicing a knotting method for a netting of the present invention.

Referring to FIG. 1 of the drawings, a knotting mechanism of a net producing machine for practicing the method of the present invention is shown and generally designated by the reference numeral 10. As shown, the knotting mechanism 10 includes a shuttle 12 (which is oriented toward the front of the machine) which accommodates a weft yarn A which is wound around a spool 15. The weft yarn A is paid out continuously from the spool 15 through a yarn outlet 12*a*.

Disposed above the yarn outlet 12*a* of the shuttle 12 is a bill-like upper hook 14 which is contiguous with a shank 14*a* and rotatable in a horizontal plane about an axis of the shank 14*a*. The upper hook 14 extends out from and is substantially perpendicular to the shank 14*a* and has a recess 14*b* at the underside thereof which extends horizontally along a longitudinal axis of the hook 14. A lower hook 16 is movable back and forth through the recess 14*b*, as described later in detail. The upper hook 14 is arranged to be capable of swinging rearwardly and forwardly.

A reed 18 (oriented toward the rear of the machine) is formed with a yarn hole 18*a* at an end thereof and arranged such that, while the tip of the upper hook 14 is oriented rearwardly, the yarn hole 18*a* is rotatable about the longitudinal axis of the hook 14. A warp yarn B which is paid out from a creel stand, not shown, is passed through the yarn hole 18*a* of the reed 18 to be guided thereby to the knotting mechanism 10. The lower hook 16 is located forwardly of the upper hook 14 and provided with a pawl 16*a* at the tip thereof. The hook 16 is capable of performing two different kinds of motions, i.e., a linear motion toward and away from the reed 18 during which the pawl 16*a* moves through the recess 14*b* of the hook 14, and a motion along an arcuate path which extends along the outer edge of the shuttle 12 downwardly to a position opposite to the yarn outlet 12*a* of the shuttle 12.

Further, a raising plate 20 is positioned below the upper hook 14. The raising plate 20 is movable up and down along a side of the hook 14. Specifically, while the bill-like tip of the hook 14 is oriented 90 degrees from forward, the raising plate 20 is movable upwardly from a position below the yarn outlet 12*a* of the shuttle 12.

A plurality of knotting mechanisms 10, each having the above construction, are arranged in the net producing machine and operated synchronously and simultaneously to weave a netting.

A sequence of knotting steps which the knotting mechanism 10 performs will be described with reference to FIGS. 2A to 2I.

Figure 2C:
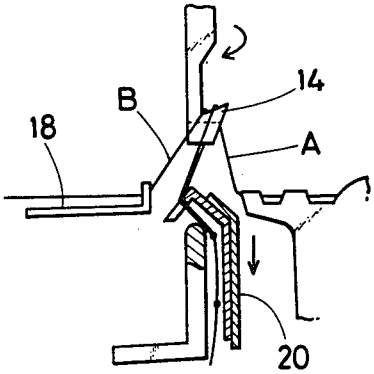
FIGS. 2A to 2I are views representative of a specific sequence of knotting steps in accordance with the present invention.
Figure 2A:
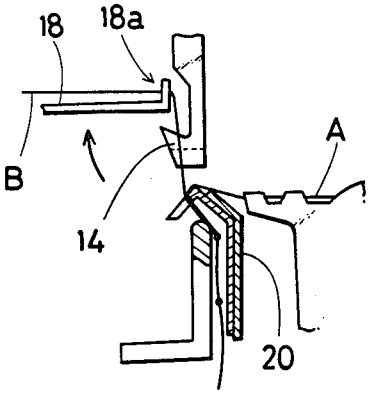
Figure 2D:
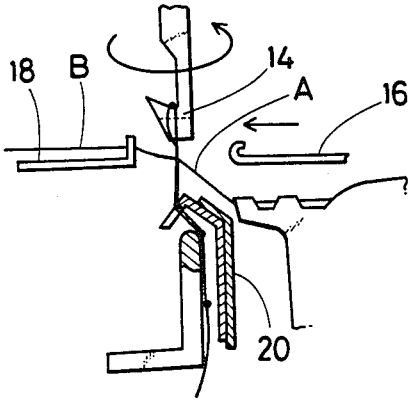
Figure 2B:
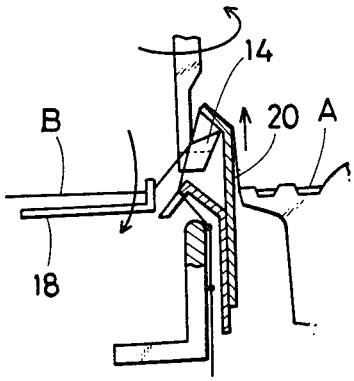

The sequence begins with positioning the yarn hole 18*a* of the reed 18 above the tip of the upper hook 14 while maintaining the hook 14 oriented rearwardly, as shown in FIG. 2A. In this condition, the warp B extends along the side of the hook 14. Then, as shown in FIG. 2B, the hook 14 is rotated 180 degrees horizontally and counterclockwise as viewed from above toward the warp side while, at the same time, the reed 18 is angularly moved to lower the yarn hole 18*a*. As a result, the warp yarn B is caught by the hook 14 straddling the hook 14 from the right to the left as viewed from the top side, i.e. from the back to the front as viewed in FIG. 2B. This is followed by moving the raising plate 20 upwardly to raise the weft yarn A to a predetermined rear, side position with respect to the direction of rotation of the hook 14, as also shown in FIG. 2B. Subsequently, the hook 14 is reversed a small angle horizontally to catch the weft A and the plate 20 is lowered, as shown in FIG. 2C, whereby the weft yarn A is caught by the hook 14 straddling it from the left to the right as viewed from the tip side. Stated another way, looking into the hook 14 in the yarn feed directions, the warp yarn B straddles the hook 14 from the left to the right and the weft yarn A from the right to the left. By the steps describe so far, the warp yarn B and the weft yarn A are caused to straddle the hook 14 with the feed directions thereof opposing each other.

Figure 2E:
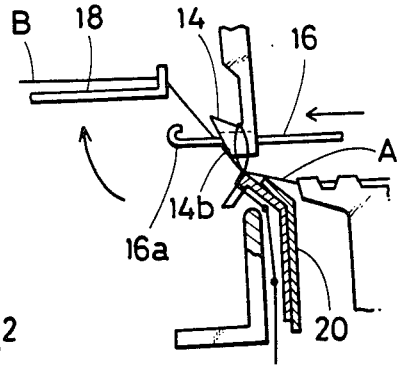
Figure 2G:
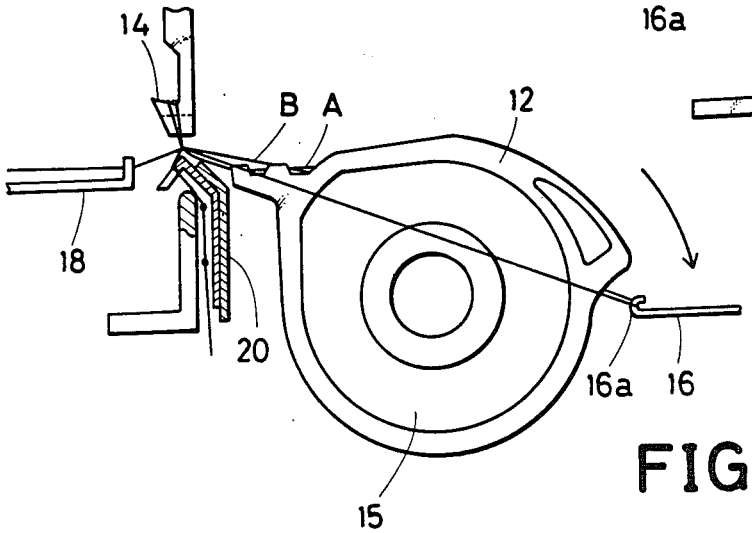
Figure 2F:
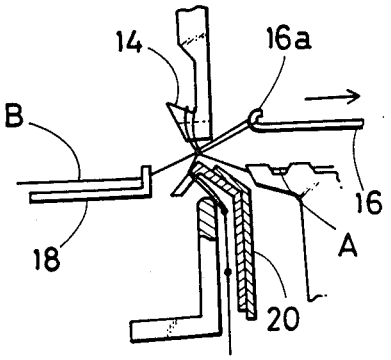
Figure 2I:
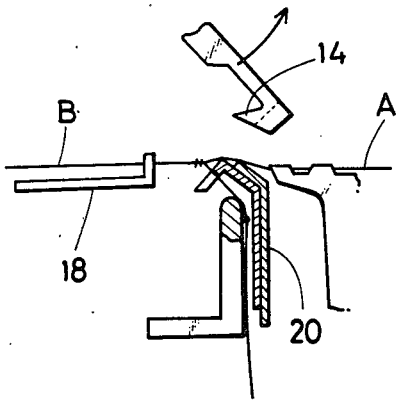
Figure 2H:
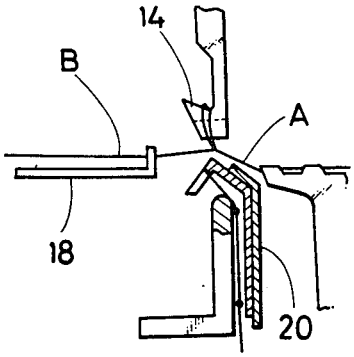

Thereafter, the upper hook 14 is rotated 180 degrees horizontally and counterclockwise as viewed from above. As a result, the yarns A and B are twisted together at a position below the hook 14 to form two substantially concentric loops around the hook 14, as shown in FIG. 2D. Then, the lower hook 16 is moved linearly rearwardly until the pawl 16*a* protrudes rearwardly beyond the bill-like tip of the hook 14 through the recess 14*b* of the hook 14, as shown in FIG. 2E. This is followed by rotating the reed 18 about the longitudinal axis of the lower hook 16 so as to hook the warp yarn B to the pawl 16*a* of the hook 16, and then, by the retraction of lower hook 16 forwardly. As the hook 16 is moved forwardly, the warp yarn B which is hooked to the pawl 16*a* is pulled forwardly through the recess 14*b* of the hook 14 while passing through the double loops of the yarns A and B, as shown in FIG. 2F. Subsequently, the hook 16 is moved along the previously stated arcuate path around the shuttle 12 to a position opposite to the yarn outlet 12*a* of the shuttle 12, as shown in FIG. 2G. At this position the warp yarn B is released from the hook 16 so that the shuttle 12 is eventually caused to go through the new loop which is formed by the warp B(FIG. 2H). Finally, as shown in FIG. 2I, the hook 14 is swung forward and upwardly to release the yarns A and B while applying tension to the yarns A and B to tie them up firmly.

Figure 3A:
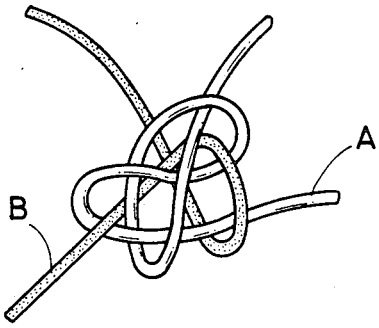
FIGS. 3A and 3B are perspective views showing a weft yarn and a warp yarn which are intertwined to form a knot by the steps of FIGS. 2A to 2I.
Figure 3B:
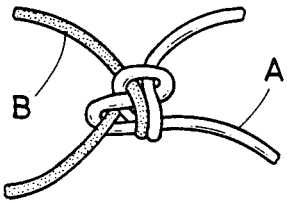

A knot formed by the above procedure is shown in FIGS. 3A and 3B. Specifically, the weft yarn A and the warp yarn B are manipulated to form individual loops which are opposite in feed direction to each other and, then, each of the yarns A and B is effectively passed through the loops of the other yarn, as shown in FIG. 3A. FIG. 3B shows the intertwined yarns A and B in a tightened condition. Such a knot attains firmness which is necessary and sufficient for a gill net and, therefore, the resultant net is free from deformation, or shifts, of meshes. In addition, the knot is very small by virtue of the unique intertwined configuration.

Figure 4C:
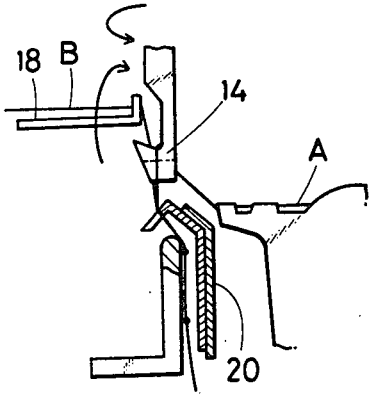
FIGS. 4A to 4G show a modification to the knotting sequence as shown in FIGS. 2A to 2I.
Figure 4A:
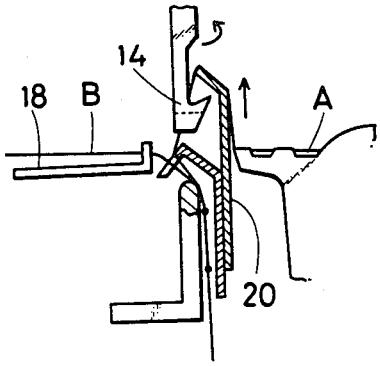
Figure 4D:
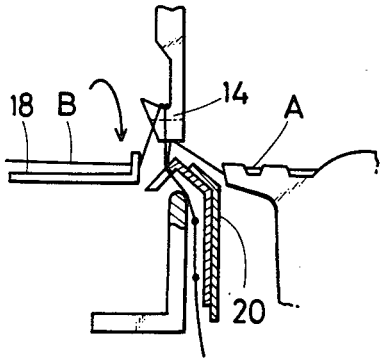
Figure 4B:
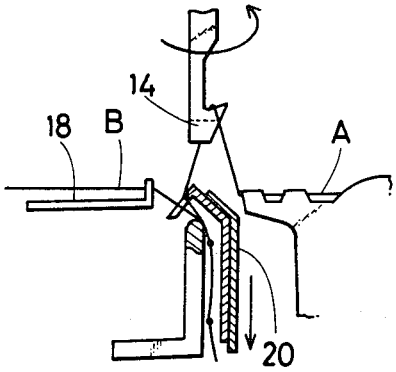
Figure 4E:
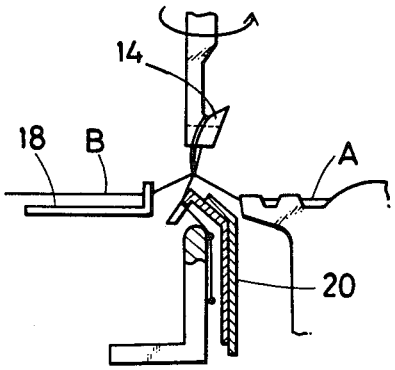
Figure 4G:
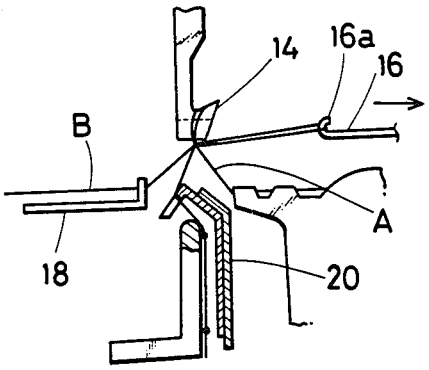
Figure 4F:
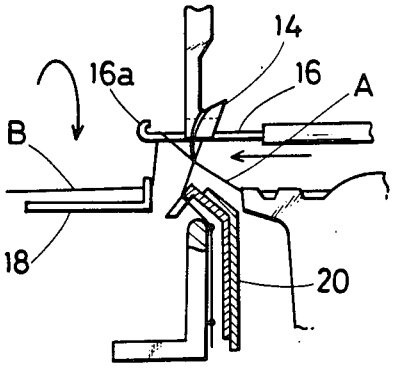

A modification to the procedure as discussed above with reference to FIGS. 2A to 2I is shown in FIGS. 4A to 4E. The alternative procedure begins as the upper hook 14 begins a 180 degree rotation from rearward tip orientation to forward. When upper hook 14 reaches a point approximately 90 degrees in its rotation, the raising plate 20 is moved upwardly lifting a weft yarn A, to a position forward of upper hook and the upper hook continues its counterclockwise rotation to position shown in FIG. 4A Under this condition, the hook 14 is rotated 180 degrees counterclockwise while, at the same time, the raising plate 20 is lowered, as shown in FIGS. 4B and 4C. This causes the weft yarn A to be caught by the hook 14 from the right to the left as viewed from the tip side. After the hook 14 has been oriented rearwardly by such an angular movement, the reed 18 is rotated about the longitudinal axis of the hook 14 to wrap the warp yarn B around the hook 14 from the left to the right as viewed form the tip side, as shown in FIGS. 4C and 4D. The hook 14 is rotated another 180 degrees counterclockwise from the position of FIG. 4D to the position of FIG. 4E in the same direction as the first 180 degrees rotation. As a result, the yarns A and B, which are opposite in feed direction to each other, are twisted together to form loops around the hook 14, as shown in FIG. 4E. Under this condition, the lower hook 16 is advanced to cause the pawl 16*a* thereof to be passed through the recess 14*b* of the upper hook 14 and, then, the reed 18 is rotated with the result that the warp yarn B is caught by the pawl 16*a* of the hook 16, as shown in FIG. 4F. This is followed by retracting the hook 16 forwardly with the warp yarn B wrapped around pawl 16*a*, as shown in FIG. 4G. Subsequently, as in the previously stated procedure, the shuttle 12 is passed through the loop of the yarn B which has been pulled out by the hook 16 as stated above. Finally, the hook 14 is swung rearward and upwardly to release the yarns A and B, followed by tightening the intertwined yarns A and B to form a knot.

Further, in any of the procedures shown and described, the wrapping directions of the yarns A and B and the rotating directions of the upper hook 14 may each be inverted.

It is to be noted that the motions of the various mechanical parts as described above are effected accurately by cams and link mechanisms which are associated therewith. It will readily occur to those skilled in the art that the cams and link mechanisms may be combined in various ways to modify the sequence of steps as desired.

In summary, it will be seen that the present invention provides a knotting method which offers a netting, particularly a gill net implemented with nylon monofilaments (or any other synthetic fiber raw material), with firm and very small knots which enhance a haul as well as the durability of the netting. Various modifications will become possible for those skilled in the art after receiving the teachings of the present disclosure without departing from the scope thereof.

What is claimed is:

1. A method for producing a knot for a fishing net by using a net producing machine, comprising the steps of
   (a) hanging a warp on an upper, vertical hook having a tip end, from the right side to the left as viewed from the side of said tip end;
   (b) causing the upper hook, with the warp thereon, to make a one-half revolution counterclockwise turn as viewed from above;
   (c) hanging a weft on the upper hook from the left side to the right as viewed from said tip end;
   (d) causing the upper hook, with the warp and the weft thereon, to make a further one-half revolution counterclockwise turn, as viewed from above, to return the hook to its original position, thereby making a warp and weft look around the hook;
   (e) passing a lower, horizontal hook having a tip end, through the warp and weft loop from the side where the weft has been hung on the upper hook so that said tip end of the lower hook comes to the opposite side;
   (f) hanging a portion of the warp not forming the warp and weft loop on the tip of the lower hook;
   (g) retracting the lower hook, with said portion of the warp thereon, through the warp and weft look so that said tip end of the lower hook returns to the other side and so that said portion of the warp passes through the warp and weft loop to form a warp loop on the other side;
   (h) causing a spool to go through said warp loop;
   (i) releasing the warp and the weft from the upper hook; and
   (j) tensioning the warp and the weft.

2. A method in accordance with claim 1 wherein step (a) further comprises hanging the warp on the upper hook by moving the warp from the right side to the left of the upper hook.

3. A method in accordance with claim 1 wherein, in steps (a) and (b), the warp is moved upwardly on the right side of the upper hook, as viewed from the side of said tip end, and then said one-half revolution counterclockwise turn of the upper hook and a downward movement of the warp are made in a substantially simultaneous manner, thereby hanging the warp on the upper hook.

4. A method in accordance with claim 1, wherein in step (d) the weft is hung on the upper hook by moving a lifting plate upwardly, on the left side of the upper hook as viewed from the side of said tip end, so that the plate contacts and lifts the warp, causing the upper hook to make a slight clockwise turn as viewed from above, and then lowering the lifting plate.

5. A method for producing a knot for a fishing net by using a net producing machine, comprising the steps of
   (a) hanging a warp on an upper, vertcal hook having a tip end, from the left side to the right as viewed from the side of said tip end;
   (b) causing the upper hook, with the warp thereon, to make a one-half revolution clockwise turn as viewed from above;
   (c) hanging a weft on the upper hook from the right side to the left as viewed from said tip end;
   (d) causing the upper hook, with the warp and the weft thereon, to make a further one-half revolution clockwise turn, as viewed from above, to return the upper hook to its original position, thereby making a warp and weft loop around the hook;
   (e) passing a lower, horizontal hook having a tip end, through the warp and weft loop from the side where the weft has been hung on the upper hook so that said tip end of the lower hook comes to the opposite side;
   (f) hanging a portion of the warp not forming the warp and weft loop on the tip of the lower hook;
   (g) retracting the lower hook, with said portion of the warp thereon, through the warp and weft loop so that said tip end of the lower hook returns to the other side and so that said portion of the warp passes through the warp and weft loop to form a warp loop on the other side;
   (h) causing a spool to go through said warp loop;
   (i) releasing the warp and the weft from the upper hook; and
   (j) tensioning the warp and the weft.

6. A method in accordance with claim 5 wherein step (a) further comprises hanging the warp on the upper hook by moving the warp from the left side to the right of the upper hook.

7. A method in accordance with claim 5 wherein in the steps (a) and (b), the warp is moved upwardly on the left side of the upper hook, as viewed from the side of said tip end, and then said one-half revolution clockwise turn of the upper hook and a downward movement of the warp are made in a substantially simultaneous manner, thereby hanging the warp on the upper hook.

8. A method in accordance with claim 5 wherein, in step (d), the weft is hung on the upper hook by moving a lifting plate upwardly, on the right side of the upper hook as viewed from the side of said tip end, so that the plate contacts and lifts the warp, and causing the upper hook to make a slight counterclockwise turn as viewed from above, and then lowering the lifting plate.

9. A method for producing a knot for a fishing net by using a net producing machine, comprising the steps of
   (a) hanging a weft on an upper, vertical hook having a tip end, from the right side to the left as viewed from the side of said tip end;
   (b) causing the upper hook, with the weft thereon, to make a one-half revolution counterclockwise turn as viewed from above;
   (c) hanging a warp on the upper hook from the left side to the right as viewed from said tip end;
   (d) causing the upper hook, with the weft and the warp thereon, to make a further one-half counterclockwise turn, as viewed from above, to return the upper hook to its original position, thereby making a weft and warp loop around the hook;
   (e) passing a lower, horizontal hook having a tip end, through the weft and warp loop from the side where the weft has been hung on the upper hook so that said tip end of the lower hook comes to the opposite side;
   (f) hanging a portion of the warp not forming the weft and warp loop on the tip of the lower hook;

(g) retracting the lower hook, with said portion of the warp thereon, through the weft and warp loop so that said tip end of the lower hook returns to the other side and so that said portion of the warp passes through the weft and warp loop to form a warp loop on the other side;

(h) causing a spool to go through said warp loop;

(i) releasing the warp and the weft from the upper hook; and (j) tensioning the warp and the weft.

10. A method in accordance with claim 9 wherein, in step (a), the weft is hung on the upper hook by moving a lifting plate upward, on the right side of the hook as viewed form the side of said top end, so that the plate contacts the lifts the weft, and then making said one-half revolution counterclockwise turn of the upper hook and a downward movement of the plate in a substantially simultaneous manner.

11. A method in accordance with claim 9 wherein, in step (c), the warp is hung on the upper hook by moving the warp from the left side to the right on the upper hook.

12. A method in accordance with claim 9 wherein, in step (c), the warp is hung on the upper hook by moving the warp upwardly on the left side of the hook, as viewed from the side of said tip end, causing the upper hook to make a slight clockwise turn as viewed from above, and then lowering the warp.

13. A method for producing a knot for a fishing net by using a net producing machine, comprising the steps of (a) hanging a weft on an upper, vertical hook having a tip end from the left side to the right as viewed from the side of said tip end;

(b) causing the upper hook, with the weft thereon, to make a one-half revolution clockwise turn as viewed from above;

(c) hanging a warp on the upper hook from the right side to the left as viewed from said tip end;

(d) causing the upper hook, with the weft and the warp thereon, to make a further one-half revolution clockwise turn, as viewed from above, to return the hook to its original position, thereby making a weft and warp loop around the hook;

(e) passing a lower, horizontal hook having tip end, through the weft and warp look from the side where the weft has been hung on the upper hook so that the tip end of the lower hook comes to the opposite side;

(f) hanging a portion of the warp not forming the weft and warp loop on the tip of the lower hook;

(g) retracting the lower hook, with said portion of the warp thereon, through the weft and warp loop so that said tip end of the lower hook returns to the other side and so that said portion of the warp passes through the weft and warp loop to form a warp loop on the other side;

(h) causing a spool to go through said warp loop;

(i) releasing the warp and the weft from the upper hook; and (j) tensioning the warp and the weft.

14. A method in accordance with claim 13 wherein, in steps (a) and (b), the weft is hung on the upper hook by moving a lifting plate, on the left side of the upper hook as viewed from the side of said tip end, so that the plate contacts and lifts the weft, and then making said one-half revolution clockwise turn of the upper hook and a downward movement of the plate in a substantially simultaneous manner.

15. A method in accordance with claim 14 wherein, in step (c), the warp is hung on the upper hook by moving the warp upward on the right side of the upper hook, as viewed from the side of said tip end, causing the upper hook to make a slight counterclockwise turn.

16. A method in accordance with claim 13 wherein, in step (c), the warp is hung on the upper hook by moving the warp from the right side to the left as viewed from the side of said tip end.

17. A method in accordance with claim 13, wherein in step (c), the warp is hung on the upper hook by moving the warp upwardly on the right side of the upper hook as viewed from the side of said tip end, causing the upper hook to make a slight counterclockwise turn, and lowering the warp.

* * * * *

UNITED STATES PATENT AND TRADEMARK OFFICE

CERTIFICATE OF CORRECTION

PATENT NO. : 4,774,870

DATED : October 4, 1988

INVENTOR(S) : Yoshiji Yamamoto et al.

It is certified that error appears in the above-identified patent and that said Letters Patent is hereby corrected as shown below: .

Column 5, line 36, replace "weft look" with --weft loop--.

Column 5, line 66, replace "vertcal hook" with --vertical hook--.

Column 7, line 14, replace "viewed form" with --viewed from--.

Signed and Sealed this

Tenth Day of April, 1990

*Attest:*

HARRY F. MANBECK, JR.

*Attesting Officer*

*Commissioner of Patents and Trademarks*